US011117242B2

(12) United States Patent
Li

(10) Patent No.: US 11,117,242 B2
(45) Date of Patent: Sep. 14, 2021

(54) MANUAL TOOL HAVING A RETRACTABLE TOOL MEMBER

(71) Applicants: HANGZHOU UNITED TOOLS CO., LTD., Hangzhou (CN); HANGZHOU GREAT STAR INDUSTRIAL CO., LTD., Hangzhou (CN)

(72) Inventor: Yueming Li, Hangzhou (CN)

(73) Assignees: HANGZHOU UNITED TOOLS CO., LTD., Hangzhou (CN); HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 316 days.

(21) Appl. No.: 16/469,066

(22) PCT Filed: Apr. 9, 2018

(86) PCT No.: PCT/CN2018/082341

§ 371 (c)(1),
(2) Date: Jun. 12, 2019

(87) PCT Pub. No.: WO2019/195983

PCT Pub. Date: Oct. 17, 2019

(65) Prior Publication Data

US 2020/0353600 A1 Nov. 12, 2020

(51) Int. Cl.

| | |
|---|---|
| ***B25B 7/12*** | (2006.01) |
| ***B25B 7/02*** | (2006.01) |
| ***B25B 7/08*** | (2006.01) |
| ***B25B 15/00*** | (2006.01) |
| ***B25B 23/00*** | (2006.01) |
| ***B25B 23/16*** | (2006.01) |
| *B26B 1/02* | (2006.01) |

(52) U.S. Cl.

CPC ..... *B25B 7/12* (2013.01); *B25B 7/02* (2013.01); *B25B 7/08* (2013.01); *B25B 15/00* (2013.01); *B25B 23/0007* (2013.01); *B25B 23/16* (2013.01); *B26B 1/02* (2013.01)

(58) Field of Classification Search

CPC .... B25B 7/00; B25B 7/02; B25B 7/04; B25B 7/06; B25B 7/08; B25B 7/12; B25B 15/00; B25B 23/00; B25B 23/0007; B25B 23/16; B23K 37/0435; B26B 1/02; B25G 1/04

See application file for complete search history.

(56) References Cited

U.S. PATENT DOCUMENTS 2,446,022 A * 7/1948 Peterson ..... B25B 7/02 81/305
6,223,374 B1 * 5/2001 Lin ..... B25F 1/003 7/127

(Continued)

FOREIGN PATENT DOCUMENTS

| | | |
|---|---|---|
| CN | 202607520 U | 12/2012 |
| CN | 103447975 A | 12/2013 |
| CN | 265552321 U | 9/2016 |

*Primary Examiner* — Robert J Scruggs
(74) *Attorney, Agent, or Firm* — Cochran Freund & Young LLC; William W. Cochran

(57) ABSTRACT

The present invention discloses a manual tool having a retractable tool member, which further comprises a handle and a linkage member. The tool member is configured to be retractably moveable relative to the handle between an operating state and a retracting state under the driving of the handle and the linkage member.

22 Claims, 14 Drawing Sheets

(56) References Cited

U.S. PATENT DOCUMENTS

| | | | | |
|---|---|---|---|---|
| 6,474,202 | B2 * | 11/2002 | Frazer | B25F 1/003 81/168 |
| 7,451,673 | B1 | 11/2008 | Petersen | |
| 7,895,756 | B1 | 3/2011 | Lin | |
| 2002/0023524 | A1 * | 2/2002 | Lowe | B25B 7/02 81/427.5 |
| 2014/0283311 | A1 * | 9/2014 | Ebrahim | B25F 5/02 7/128 |

* cited by examiner

MANUAL TOOL HAVING A RETRACTABLE TOOL MEMBER

FIELD OF THE INVENTION

The invention relates to the field of manual tools, and in particular to a manual tool having a retractable tool member.

DESCRIPTION OF THE PRIOR ART

Manual tools generally have a handle for hold and one or more tool members for specific purposes. It is desirable that the tool member, when not in use, can be retracted so as not to cause any inconvenience or injury to people. In the prior art, the tool member is often retracted in the handle in a retractable or foldable manner. To this end, it is generally required to simultaneously design a push button for deploying the tool member from the handle, a latch for locking the tool member in an operating state or a retracting state, and a guide rail, etc., thereby causing a complex structure, a high failure rate and production cost.

Moreover, it is also intended to provide more than one tool members on one manual tool to meet the needs of use in different situations, and further to hope that all these tool members can be retracted.

Therefore, those skilled in the art are devoted to developing a manual tool with a simpler and more reliable structure having a tool member that can be retracted, and such a manual tool whose tool member comprises more than one tool portions.

SUMMARY OF THE INVENTION

In view of the above-mentioned drawbacks of the prior art, the technical problem to be solved by the present invention is to provide a manual tool with a simpler and more reliable structure having a tool member that can be retracted, and such a manual tool whose tool member comprises more than one tool portions.

To achieve the foregoing object, the present invention firstly provides a manual tool having a retractable tool member, which further comprises a handle and a linkage member, wherein the handle comprises a first handle portion and a second handle portion, the first handle portion having a first proximal end and a first distal end, the second handle portion having a second proximal end and a second distal end, the first handle portion being rotatable about a first pivot located at the first proximal end, the second handle portion being rotatable about a second pivot located at the second proximal end, and the first pivot and the second pivot being connected through a connector; the linkage member comprises a first linkage member and a second linkage member, the first linkage member having a first tool end and a first handle end, and the second linkage member having a second tool end and a second handle end; a third pivot and a fourth pivot are provided on the tool member, the first linkage member being rotatably connected with the tool member through the third pivot at the first tool end, and the second linkage member being rotatably connected with the tool member through the fourth pivot at the second tool end; a fifth pivot is provided between the first proximal end and the first distal end of the first handle portion, the first linkage member being rotatably connected with the first handle portion through the fifth pivot at the first handle end, and a sixth pivot is provided between the second proximal end and the second distal end of the second handle portion, the second linkage member being rotatably connected with the second handle portion through the sixth pivot at the second handle end; and the tool member is configured to be retractably movable relative to the handle between an operating state and a retracting state under the driving of the handle and the linkage member.

In a preferred implementation mode of the present invention, when the tool member is in the operating state, the tool member is deployed beyond the first proximal end and second proximal end, and when the tool member is in the retracting state, the tool member is retracted to a position between the first proximal end and the second proximal end and between the first distal end and the second distal end.

In another preferred implementation mode of the present invention, the first handle portion and the second handle portion are provided with a linkage mechanism at the first proximal end and the second proximal end. In a further embodiment, the linkage mechanism includes mutually matched circular-arc concave-convex grooves or splines. In another embodiment, the first handle portion comprises a first component and a second component, and the second handle portion comprises a third component and a fourth component, wherein the first component has a first extension portion that can match with the third component, the fourth component has a second extension portion that can match with the second component, the first component and the third component are pivotally connected to the first pivot at the first extension portion, and the second component and the fourth component are pivotally connected to the second pivot at the second extension portion, so as to constitute the linkage mechanism and the connector.

In another preferred implementation mode of the present invention, axes of the third pivot and the fourth pivot are coincident.

In another preferred implementation mode of the present invention, the fifth pivot is located at the first proximal end adjacent to the first handle portion, and the sixth pivot is located at the second proximal end adjacent to the second handle portion.

In another preferred implementation mode of the present invention, the tool member is configured with a critical point when moving between the operating state and the retracting state, and when the tool member is at the critical point, the third pivot, the fourth pivot, the fifth pivot, and the sixth pivot are laterally aligned on the same straight line.

In another preferred implementation mode of the present invention, the tool member is a pliers head, which comprises a first plier body and a second plier body, wherein the third pivot is located at a tail portion of the first plier body, and the fourth pivot is located at a tail portion of the second plier body.

In another preferred implementation mode of the present invention, an abutment portion is provided at the first tool end of the first linkage member and the second tool end of the second linkage member, a groove is provided at the tail portion of the first plier body and the tail portion of the second plier body, and when the pliers head is in the operating state, the abutment portion and the groove abut against each other.

In another preferred implementation mode of the present invention, the manual tool further comprises a third linkage member that is equivalent to the first linkage member and a fourth linkage member that is equivalent to the second linkage member, wherein the first linkage member is integrated with the third linkage member, and the second linkage member is integrated with the fourth linkage member.

The present invention further provides a manual tool having a retractable tool member, which further comprises a handle and a linkage member, wherein the handle comprises a first handle portion and a second handle portion, the first handle portion having a first proximal end and a first distal end, the second handle portion having a second proximal end and a second distal end, the first handle portion being rotatable about a first pivot located at the first proximal end, the second handle portion being rotatable about a second pivot located at the second proximal end, and the first pivot and the second pivot being connected through a connector; the linkage comprises a first linkage member and a second linkage member, the first linkage member having a first tool end and a first handle end, and the second linkage member having a second tool end and a second handle end; the tool member comprises a first tool head and a second tool head opposite to the first tool head, and a third pivot is provided on the tool member, the first linkage member being rotatably connected with the tool member through the third pivot at the first tool end, and the second linkage member being rotatably connected with the tool member through the third pivot at the second tool end; a fourth pivot is provided between the first proximal end and the first distal end of the first handle portion, the first linkage member being rotatably connected with the first handle portion through the fourth pivot at the first handle end, and a fifth pivot is provided between the second proximal end and the second distal end of the second handle portion, the second linkage member being rotatably connected with the second handle portion through the fifth pivot at the second handle end; and the tool member is configured to be retractably movable relative to the handle among a first operating state, a first retracting state, a second operating state, and a second retracting state under the driving of the handle and the linkage member.

In another preferred implementation mode of the present invention, the first handle portion and the second handle portion are provided with a linkage mechanism at the first proximal end and the second proximal end. In a further embodiment, the linkage mechanism includes a mutually matched circular-arc concave-convex grooves or splines. In another embodiment, the first handle portion comprises a first component and a second component, and the second handle portion comprises a third component and a fourth component, wherein the first component has a first extension portion that can match with the third component, the fourth component has a second extension portion that can match with the second component, the first component and the third component are pivotally connected to the first pivot at the first extension portion, and the second component and the fourth component are pivotally connected to the second pivot at the second extension portion, so as to constitute the linkage mechanism and the connector.

In another preferred implementation mode of the present invention, the fifth pivot is located at the first proximal end adjacent to the first handle portion, and the fifth pivot is located at the second proximal end adjacent to the second handle portion.

In another preferred implementation mode of the present invention, the tool member is configured with a critical point when moving among the first operating state, the second operating state, the first retracting state, and the second retracting state, and when the tool member is at the critical point, the first pivot, the second pivot, the third pivot, the fourth pivot, and the fifth pivot are laterally aligned on the same straight line.

In another preferred implementation mode of the present invention, when the tool member is in the first operating state, the first tool head is deployed beyond the first proximal end and the second proximal end; when the tool member is in the first retracting state, the tool member is retracted to a position between the first proximal end and the second proximal end and between the first distal end and the second distal end, and the first tool head faces the first proximal end and the second proximal end; when the tool member is in the second operating state, the second tool head is deployed beyond the first proximal end and the second proximal end; when the tool member is in the second retracting state, the tool member is retracted to a position between the first proximal end and the second proximal end and between the first distal end and the second distal end, and the second tool head faces the first proximal end and the second proximal end.

In another preferred implementation mode of the present invention, the manual tool further comprises a third linkage member that is equivalent to the first linkage member and a fourth linkage member that is equivalent to the second linkage member, wherein the first linkage member is integrated with the third linkage member, and the second linkage is integrated with the fourth linkage member.

In another preferred implementation mode of the present invention, the first tool head and the second tool head are respectively a first pliers head and a second pliers head formed by alternatively hinging a first plier body and a second plier body at the third pivot.

In another preferred implementation mode of the present invention, the first plier body and the second plier body are provided, at the third pivot, with an elastic member that biases jaws of the first pliers head and the second pliers head in an opening direction.

In another preferred implementation mode of the present invention, the fourth pivot is a first pin and the fifth pivot is a second pin, wherein when the tool member is in the first operating state, the first pin and the second pin abut against both sides of the second pliers head, respectively, so that the jaw of the first pliers head opens and closes under the action of the elastic member and the pin; when the tool member is in the second operating state, the first pin and the second pin abut against both sides of the first pliers head, respectively, so that the jaw of the second pliers heads opens and closes under the action of the elastic member and the pin.

In another preferred implementation mode of the present invention, a groove is provided at positions where the first pliers head or the second pliers head abuts against the first pin and the second pin.

In another preferred implementation mode of the present invention, the handle is provided with an arc-shaped groove at the fourth pivot and the fifth pivot, wherein the fourth pivot and the fifth pivot are movable in the arc-shaped groove.

In another preferred implementation mode of the present invention, the first tool head is a first tool bit and the second tool head is a second tool bit.

In another preferred implementation mode of the present invention, the first tool head is a first screwdriver bit and the second tool head is a second screwdriver bit.

The concepts, specific structures, and technical effects of the present invention will be further described below with reference to the accompanying drawings to fully understand the object, features, and effects of the present invention.

DETAILED DESCRIPTION OF THE PREFERRED IMPLEMENTATION MODES

The present invention will be further illustrated below with reference to the accompanying drawings and specific embodiments.

Figure 1:
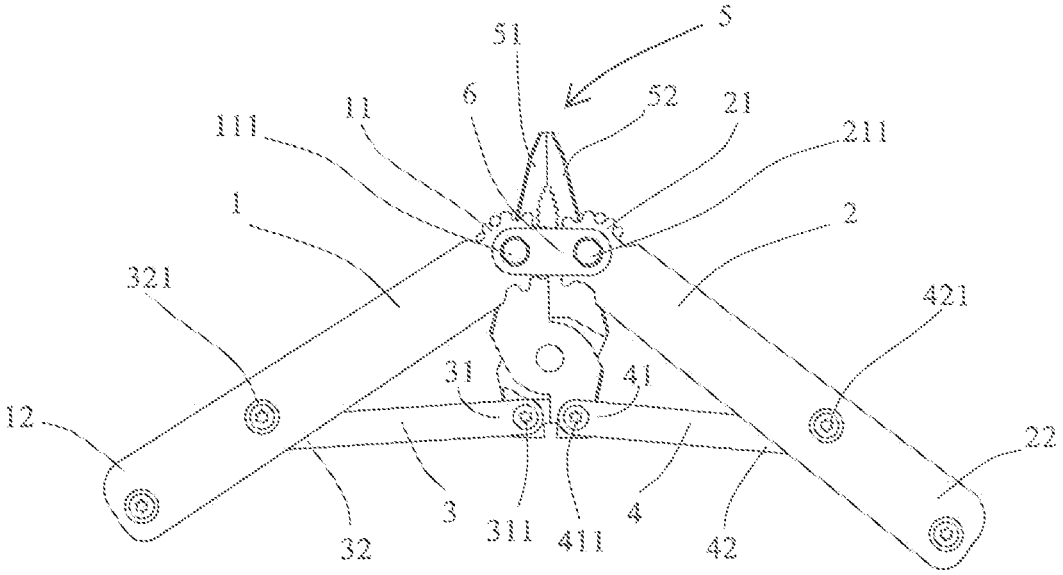
FIG. 1 is a schematic view of a retractable pliers in an embodiment according to the present invention.
Figure 2:
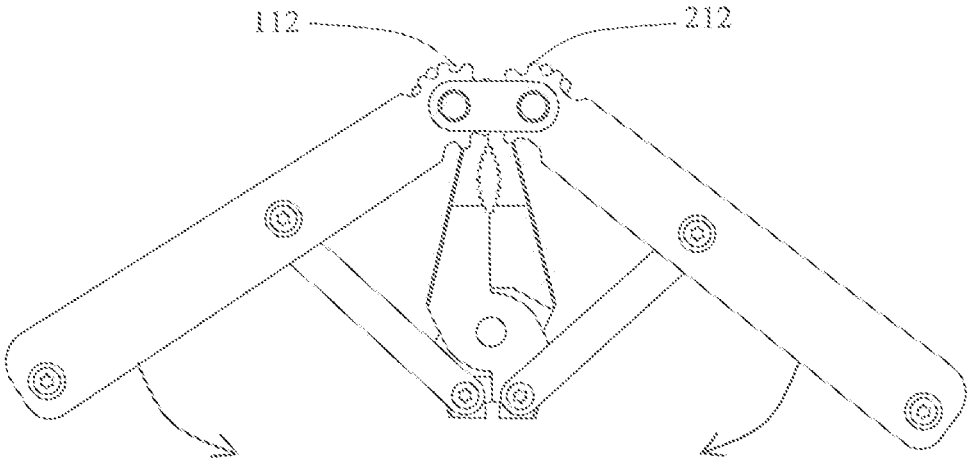
FIG. 2 is a schematic view of a retractable pliers during retraction in an embodiment according to the present invention.

The present invention firstly provides a manual tool whose tool member can be retracted and deployed. FIGS. 1 and 2 show a retractable pliers according to the present invention, which comprises a retractable pliers head 5, a handle and a linkage member. The handle comprises a handle portion 1 and a handle portion 2, wherein the handle portion 1 has a proximal end 11 and a distal end 12, the handle portion 2 has a proximal end 21 and a distal end 22, the handle portion 1 is rotatable about a pivot 111 located at the proximal end 11, and the handle 2 is rotatable about a pivot 211 located at the proximal end 21. The pivots 111 and 211 are connected by a connector 6. The linkage member comprises a linkage member 3 and a linkage member 4, wherein the linkage member 3 has a tool end 31 and a handle end 32, and the linkage member 4 has a tool end 41 and a handle end 42. The pliers head 5 is formed by alternatively hinging pliers bodies 51 and 52. The tool end 31 of the linkage member 3 is rotatably connected with a tail portion of the pliers body 52 through a pivot 311, and the handle end 21 of the linkage member 3 is rotatably connected with the handle portion 1 through a pivot 321. The tool end 41 of the linkage member 4 is rotatably connected with a tail portion of the pliers body 51 through a pivot 411, and the handle end 41 of the linkage member 4 is rotatably connected with the handle portion 2 through a pivot 421.

When the handle portions 1, 2 open or close, the pliers head 5 retractably moves relative to the handle under the driving of the linkage members 3, 4, so as to be configured in the operating state or the retracting state. When in the operating state, the pliers head 5 is deployed beyond the proximal ends 11, 21 of the handle; when in the retracting state, the pliers head 5 is retracted back into the handle, locating between the proximal ends 11, 21 and the distal ends 21, 22 of the handle.

Figure 3:
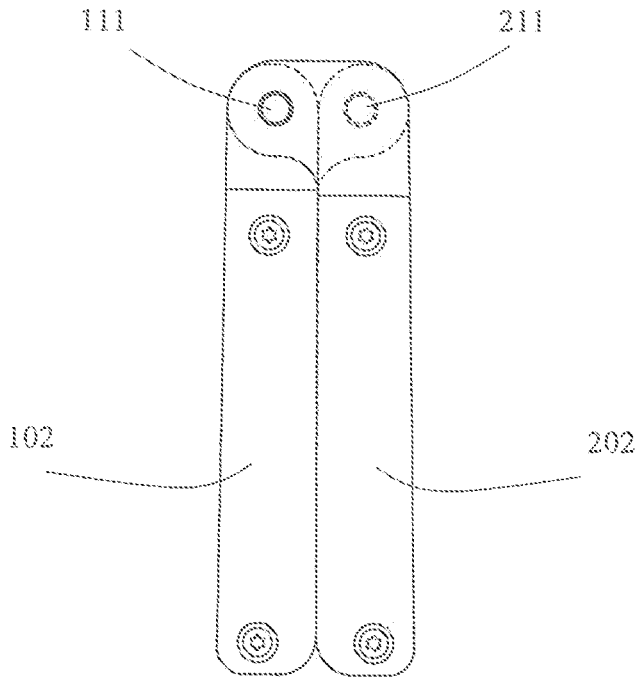
FIG. 3 is a schematic view of a retractable pliers that is closed in an embodiment according to the present invention.
Figure 4:
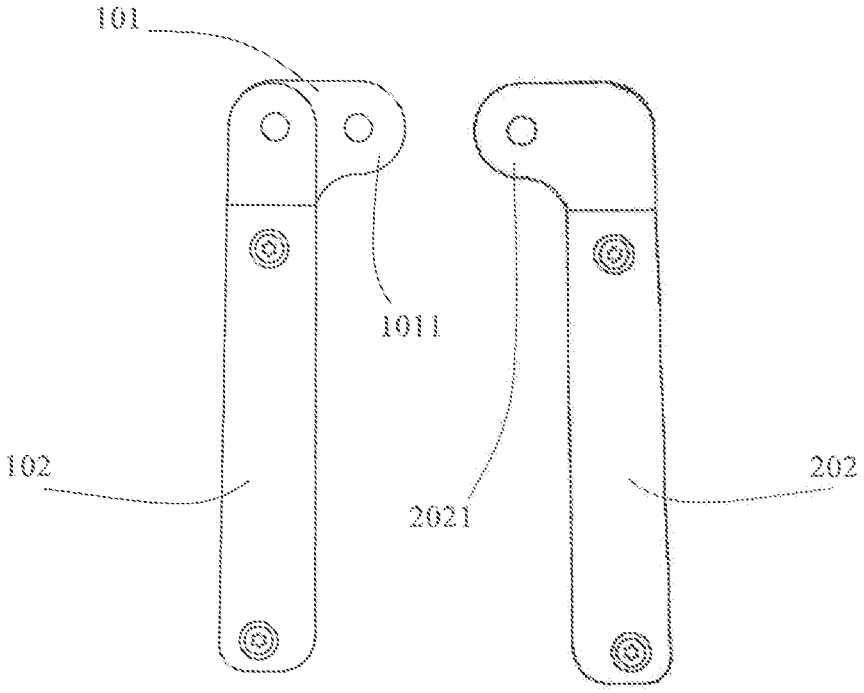
FIG. 4 is a schematic view of a linkage mechanism in an embodiment according to the present invention.
Figure 5:
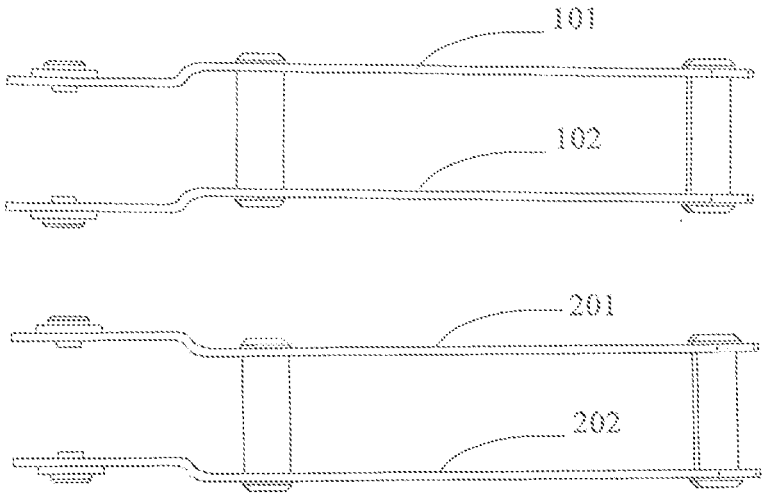
FIG. 5 is a schematic view of a linkage mechanism in an embodiment according to the present invention.

The retractable pliers is also provided with a linkage mechanism at the proximal ends 11, 21 of the handle. In this embodiment, the linkage mechanism includes mutually matched splines 112, 212 as shown in FIG. 2, so that when the handle portion 1 or 2 moves, the other handle portion 2 or 1 synchronously moves. In other embodiments, the linkage mechanism may also include mutually matched concave-convex grooves. In yet another embodiment, as shown in FIGS. 3, 4 and 5, the handle portion 1 comprises components 101, 102, and the handle 2 comprises components 201, 202, wherein the component 101 has an extension portion 1011 that matches with the component 201, and the component 202 has an extension portion 2021 that matches with the component 102. The component 101 and the component 201 are pivotally connected to the pivot 111 at the extension portion 1011, and the component 102 and the component 202 are pivotally connected to the pivot 211 at the extension portion 2021, thereby constituting the linkage mechanism and the connector.

Figure 6:
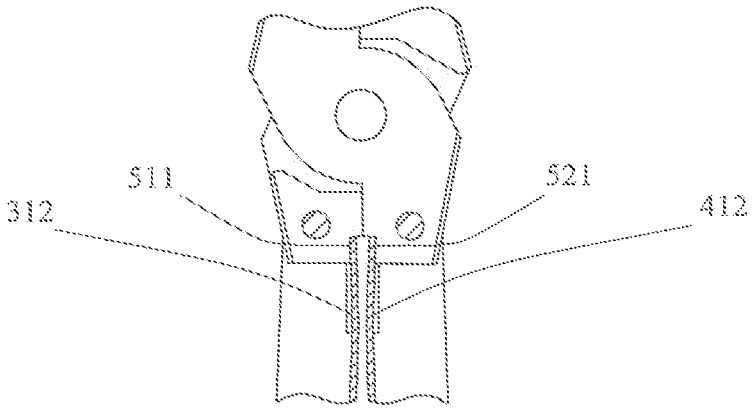
FIG. 6 is a schematic view of an abutment portion and a groove in an embodiment according to the present invention.

As shown in FIG. 6, the linkage members 3, 4 are provided with abutment portions 312, 412 at the tool ends 31, 41, respectively, and are provided with grooves 511, 521 at the tail portions of the pliers bodies 51, 52, respectively. When the pliers head 5 of the retractable pliers is in the operating state, the abutment portions 312, 412 respectively abut against the grooves 511, 521 to control the opening and closing of the pliers head 5.

The handle portions 1, 2, the linkage members 3, 4 and the pliers head 5 substantially constitute a planar link system so that the pliers head 5 can retractably move, through the linkage members 3, 4, with the opening and closing movements of the handle portions 1, 2. The link system has a critical point as shown in FIG. 1. At this point, the pivots 311, 411, 321, and 421 are laterally aligned on the same straight line. The handle portions 1, 2 can be opened from the closed state to the state of the critical point. When the pliers head 5 moves toward the proximal ends 11, 21 of the handle to cross the critical point, closing the handles 1, 2 at this time will allow the pliers head 5 to continue extending and finally reach the operating state. When the pliers head 5 moves toward the proximal end 11, 21 of the handle to cross the critical point, closing the handles 1, 2 at this time will allow the pliers head 5 to continue extending and finally reach the operating state. Conversely, when the pliers head 5 moves toward the proximal ends 12, 22 of the handle to cross the critical point, closing the handles 1, 2 at this time will allow the pliers head 5 to retract and finally return to the retracting state.

Figure 8:
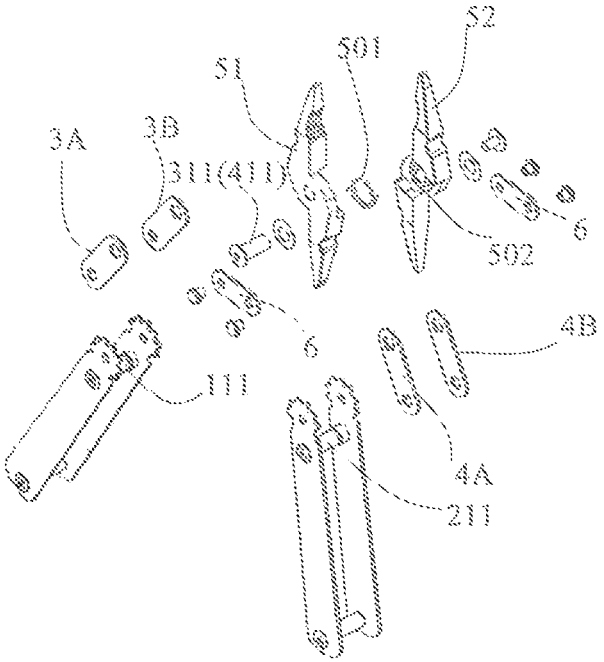
FIG. 8 is an exploded view of a dual-head retractable pliers in an embodiment according to the present invention.
Figure 9:
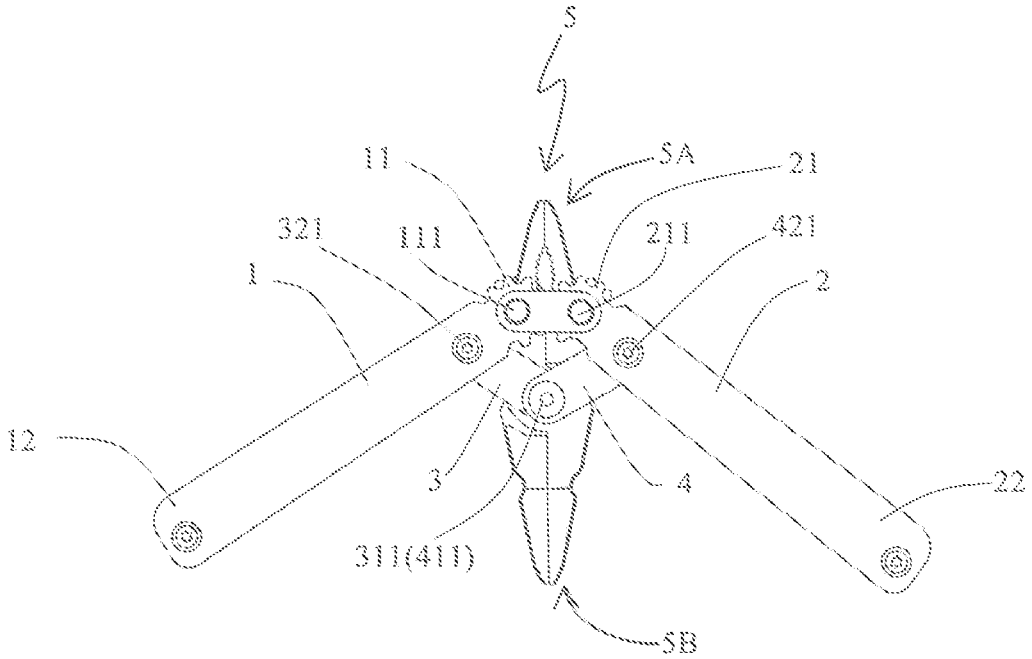
Figure 19:
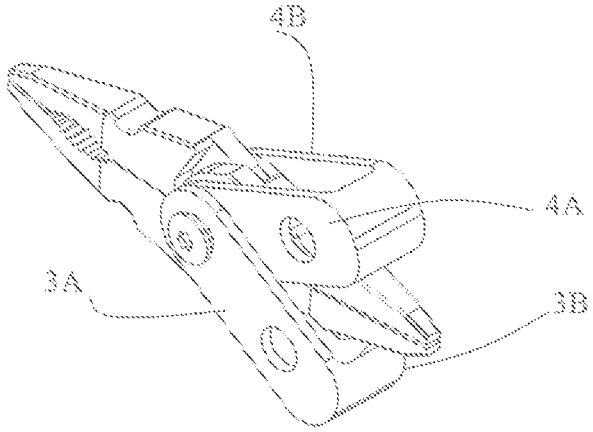
Figure 20:
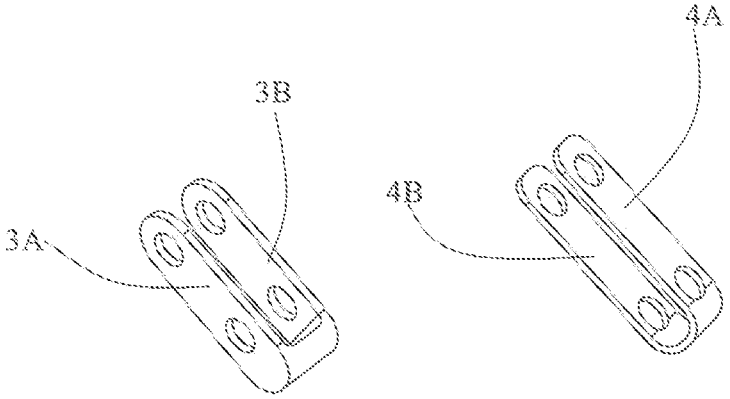

In the present embodiment, the linkage members 3, 4 are located on one side of the pliers head 5. In another embodiment, the linkage members 3, 4 are located on both sides of the pliers head 5, respectively. In another embodiment, the linkage members 3A, 4A are located on one side of the pliers head 5, and the other side is provided with linkage members 3B, 4B that are equivalent to the linkage members 3A, 4A, respectively, as shown in FIG. 8. Further, the linkage members 3A, 3B are integrally formed by, for example, a bending process for sheet metal, and the linkage members 4A, 4B are also integrally formed by, for example, a bending process for sheet metal, as shown in FIGS. 19 and 20.

In addition, in the present embodiment, the pivots 311 and 411 can also be coincident, i.e., they are actually the same pivot.

Figure 7:
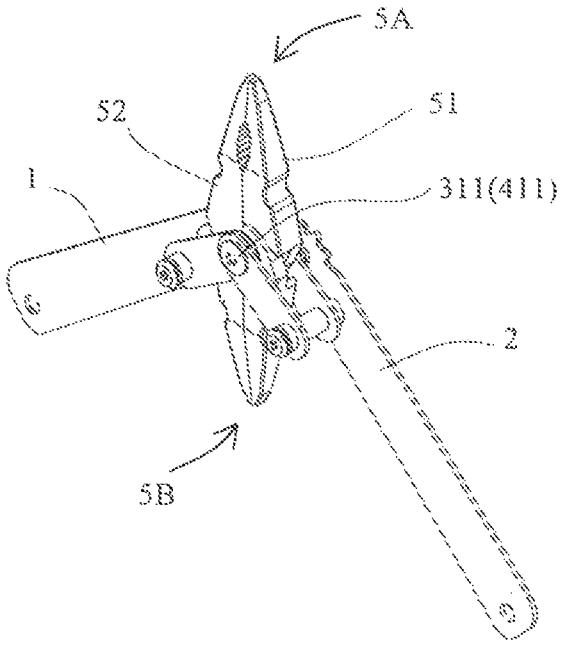
FIGS. 7 and 9-14 are schematic views of a dual-head retractable pliers in an embodiment according to the present invention.
Figure 10:
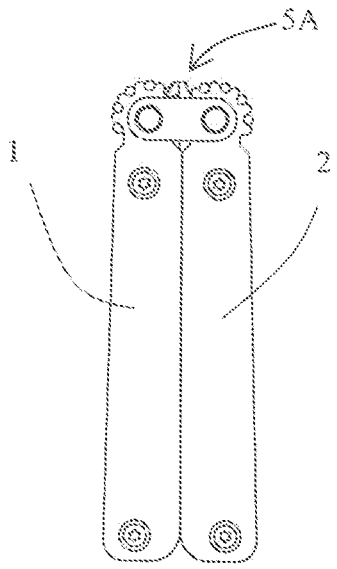
Figure 12:
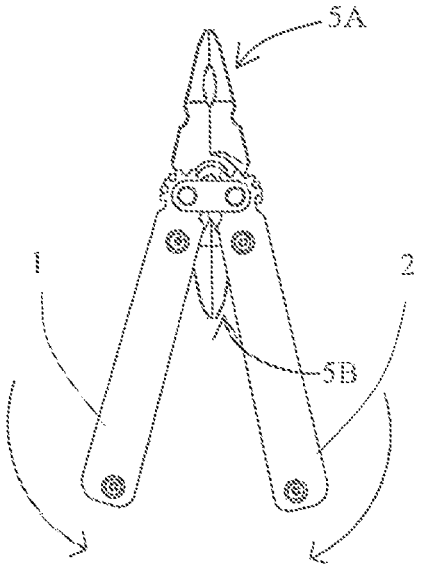
Figure 13:
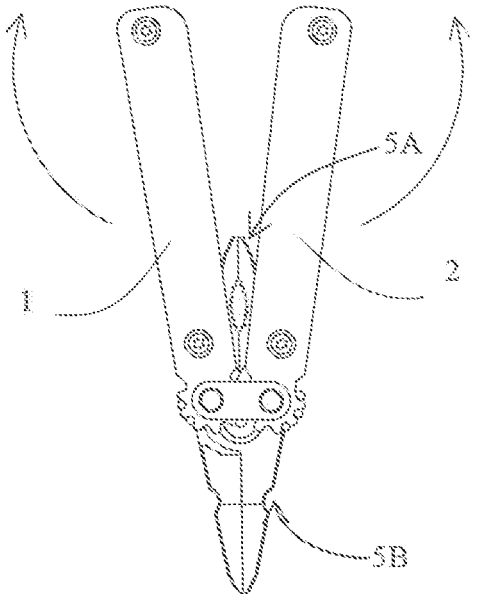
Figure 14:
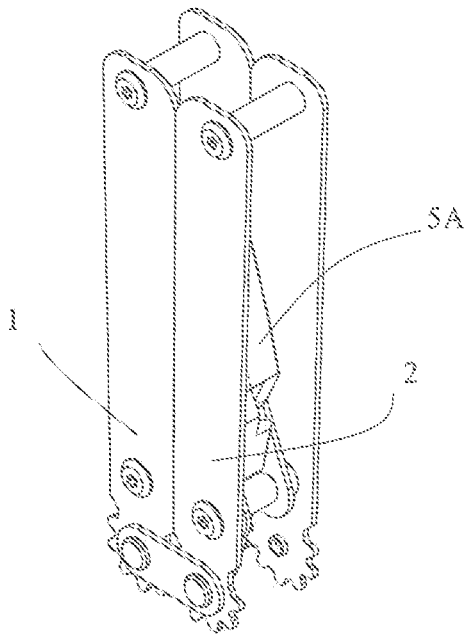
Figure 15:
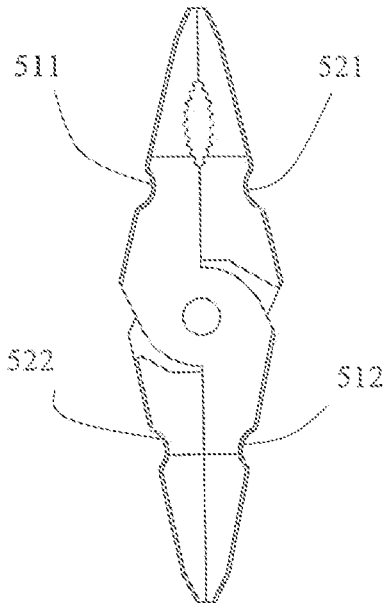
FIGS. 15 and 16 are schematic views of a relief groove in an embodiment according to the present invention.

The present invention further provides such a manual tool that comprises more than one tool portions. See the embodiments shown in FIGS. 7 and 8. In the embodiment, the tool member 5 comprises a pliers head 5A and a pliers head 5B opposite to the pliers head 5A. In this embodiment, the pivot 311 and the pivot 411 are coincident, i.e., they actually become one pivot. The pliers head 5A and the pliers head 5B are formed by alternately hinging the pliers body 51 and the pliers body 52 at the pivot 311 (411). In the embodiment, under the driving of the handle and the linkage member, the tool member 5 has four states with respect to the handle: a first operating state in which the pliers head 5A is deployed beyond the proximal ends 11, 21, as shown in FIG. 12; a second operating state in which the pliers head 5B is deployed beyond the proximal ends 11, 21, as shown in FIG. 13; a first retracting state in which the pliers heads 5A, 5B are retracted to a position between the proximal ends 11, 21 and the distal ends 12, 22 of the handle, and the pliers head 5A faces the proximal ends 11, 21, as shown in FIG. 10; and a second retracting state in which the pliers heads 5A, 5B are retracted to a position between the proximal ends 11, 21 and the distal ends 12, 22 of the handle, and the pliers head 5B faces the proximal ends 11, 21, as shown in FIG. 14.

Figure 11:
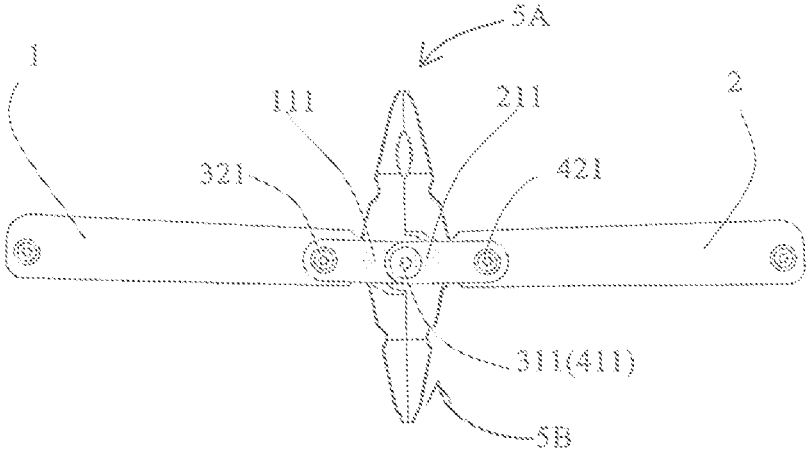

In this embodiment, in order to allow the tool member 5 to move relative to the handle among these four states, the handle portions 1, 2, the linkage members 3, 4 and the pliers head 5 substantially constitute a planar link system, and the system has a critical point as shown in FIG. 11. At this point, the pivots 311 (411), 111, 211, 321, and 421 are laterally aligned on the same straight line substantially. The handle portions 1, 2 can be opened from the first or second retracting state as shown in FIG. 10 or 14 to the critical point as shown in FIG. 11. Under the case, the following may occur: (1) if the tool member 5 moves toward the pliers head 5A to cross the critical point and the handles 1, 2 are closed toward the pliers heads 5B, then the tool member 5 will be placed in the first operating state as shown in FIG. 12; (2) if the tool member 5 moves toward the pliers heads 5A to cross the critical point and the handle portions 1 and 2 are closed toward the pliers head 5A, then the tool member 5 will be placed in the second retracting state as shown in FIG. 14; (3) if the tool member 5 moves toward the pliers head 5B to cross the critical point and the handle portions 1, 2 are closed toward the pliers head 5A, then the tool member 5 will be placed in the second operating state as shown in FIG. 13; (4) if the tool member 5 moves toward the pliers head 5B to cross the critical point and the handle portions 1 and 2 are closed toward the pliers heads 5B, then the tool member 5 will be placed in the first retracting state as shown in FIG. 12.

Figure 16:
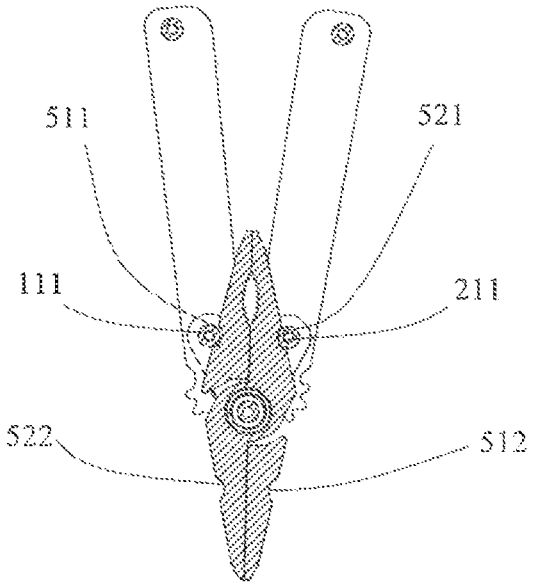
Figure 17:
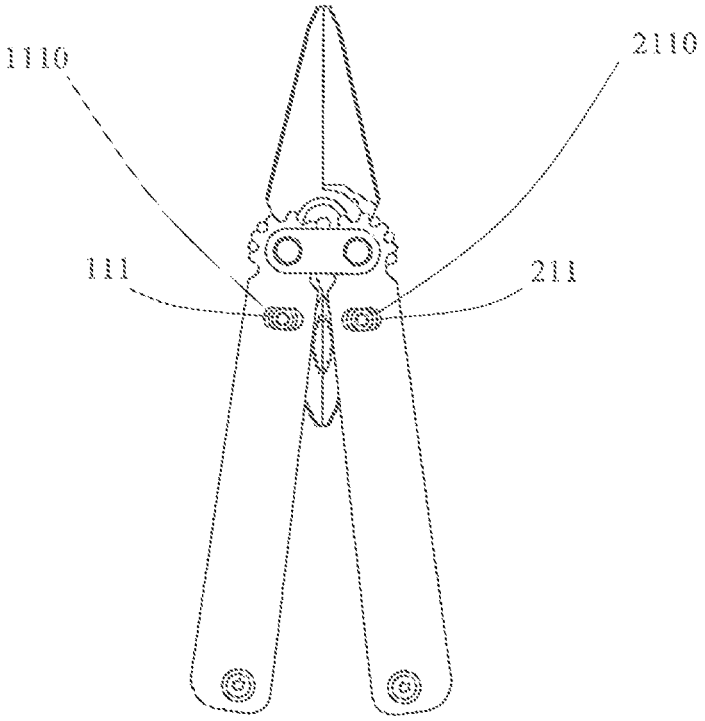
FIG. 17 is a schematic view of an arc-shaped groove in an embodiment according to the present invention.
Figure 18:
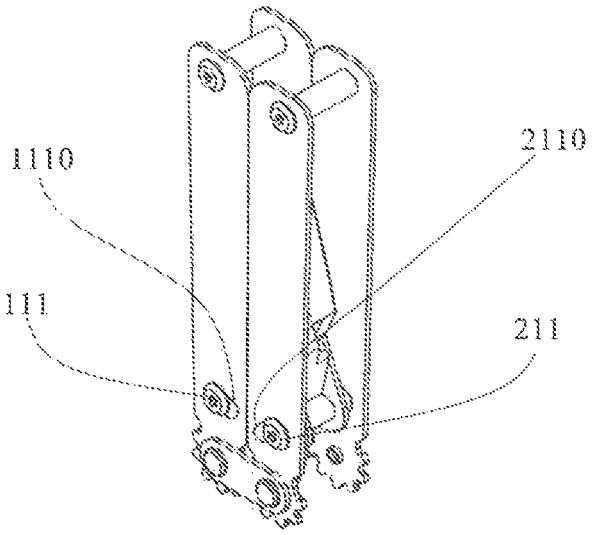
FIGS. 18-20 are schematic views of an integrally formed linkage member in an embodiment according to the present invention.

As shown in FIG. 8, the pliers bodies 51, 52 are provided with a torsion spring 501 and a receiving groove 502 on the engaging surface at the pivot 311 (411) so that the jaws of the pliers heads 5A, 5B are subject to a biasing force in the opening direction. In the embodiment, the pivots 111, 211 are pins. As shown in FIG. 16, when the pliers head 5A or 5B is in the operating state, the pins 111, 211 abut against both sides of the pliers head 5B or 5A, respectively, so that the jaws can be opened and closed under the action of the torsion spring 501. In a further embodiment, grooves 511, 512, 521, and 522 are provided at positions where the pliers head 5A or 5B abuts against the pins 111, 211, so that when the pliers head function is used, the opening angle of the handle is smaller, which facilitates hold and applying a force and provides a larger retracting area within the handle. In another further embodiment, instead of providing the grooves 511, 512, arc-shaped grooves 1110, 2110 are provided on positions where the handle matches with the pins 111, 211. The pins 111, 211 are movable in the arc-shaped grooves 1110, 2110, as shown in FIGS. 17 and 18, which can also achieve the effects of reducing the opening angle of the handle, facilitating hold and applying a force, and providing a larger retracting area within the handle when the pliers head function is used. In addition, when the widths of the functional parts of the two heads are not the same, the requirement that the opening angle of the handle changes a little when different functional parts are used can be substantially satisfied by providing the grooves or the arc-shaped grooves, thereby achieving a purpose that a user can feel comfortable and apply a force easily.

Figure 21:
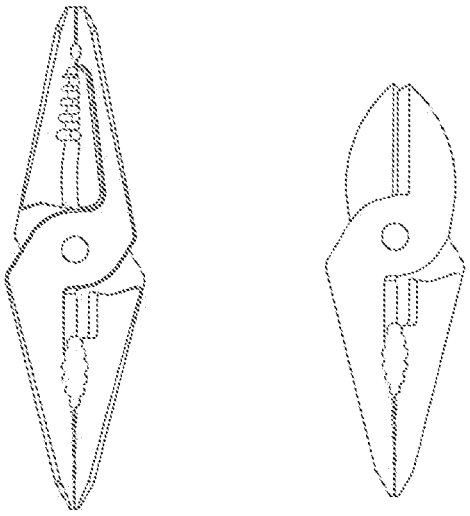
FIG. 21 is a schematic view of another form of pliers head in an embodiment according to the present invention.

As shown in FIG. 21, the tool member 5 can also be other type of dual-head pliers.

Figure 22:
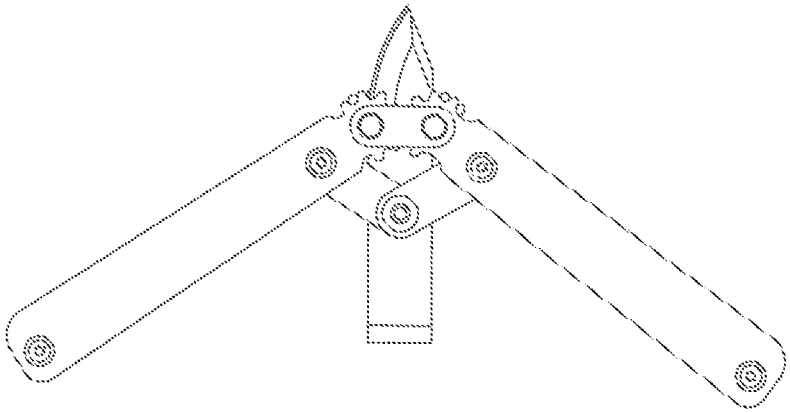
FIGS. 22 and 23 are dual-head retractable cutters in an embodiment according to the present invention.

As shown in FIG. 22, the tool member 5 may also be a dual-head cutting tool.

Figure 23:
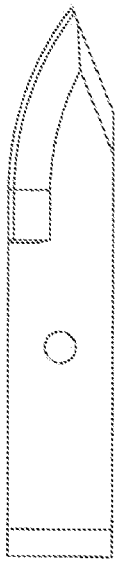
Figure 24:
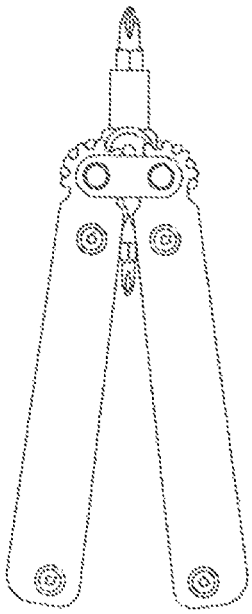
FIGS. 24-26 are schematic views of a dual-head retractable screwdriver bit and heads of the screwdriver bit in an embodiment according to the present invention.
Figure 25:
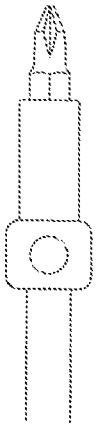
Figure 26:
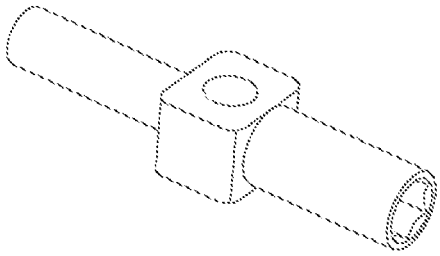

As shown in FIGS. 23, 24, and 25, the tool member 5 may also be a dual-head screwdriver bit, and the heads of the screwdriver bit may also be one of various types of sleeves.

The handle portion can also be configured with other functional parts, just as a common multi-function pliers. Moreover, the functional parts can be used when the head is retracted in the handle, which is simple, quick, convenient and safe in operation.

The specific preferred embodiments of the present invention have been described in detail above. It should be understood that those ordinarily skilled in the art could make various modifications and changes based on the concept of the present invention without creative work. Therefore, any technical solution that can be obtained through logic analysis, reasoning, or limited experimentations in combination with the prior art by a person skilled in the art according to the concept of the present invention should fall within the protective scope defined by the claims.

What is claimed is:

1. A manual tool having a retractable tool member, further comprising a handle and a linkage member, wherein the handle comprises a first handle portion and a second handle portion, the first handle portion having a first proximal end and a first distal end, the second handle portion having a second proximal end and a second distal end, the first handle portion being rotatable about a first pivot located at the first proximal end, the second handle portion being rotatable about a second pivot located at the second proximal end, and the first pivot and the second pivot being connected through a connector;

the linkage member comprises a first linkage member and a second linkage member, the first linkage member having a first tool end and a first handle end, and the second linkage member having a second tool end and a second handle end;

the tool member has a third pivot and a fourth pivot, the first linkage member being rotatably connected with the tool member through the third pivot at the first tool end, and the second linkage member being rotatably connected with the tool member through the fourth pivot at the second tool end;

a fifth pivot is provided between the first proximal end and the first distal end of the first handle portion, the first linkage member being rotatably connected with the first handle portion through the fifth pivot at the first handle end, and a sixth pivot is provided between the second proximal end and the second distal end of the second handle portion, the second linkage member being rotatably connected with the second handle portion through the sixth pivot at the second handle end; and the tool member is configured to be retractably movable relative to the handle between an operating state and a retracting state under the driving of the handle and the linkage member.

2. The manual tool having a retractable tool member according to claim 1, wherein when the tool member is in the operating state, the tool member is deployed beyond the first proximal end and second proximal end; and when the tool member is in the retracting state, the tool member is retracted to a position between the first proximal end and the second proximal end and between the first distal end and the second distal end.

3. The manual tool having a retractable tool member according to claim 1, wherein the first handle portion and the second handle portion are provided with a linkage mechanism at the first proximal end and the second proximal end.

4. The manual tool having a retractable tool member according to claim 3, wherein the linkage mechanism includes a mutually matched circular-arc concave-convex grooves or splines.

5. The manual tool having a retractable tool member according to claim 3, wherein the first handle portion comprises a first component and a second component, and the second handle portion comprises a third component and a fourth component, the first component having a first extension portion that can match with the third component, the fourth component having a second extension portion that can match with the second component, the first component and the third component being pivotally connected to the first pivot at the first extension portion, and the second component and the fourth component being pivotally connected to the second pivot at the second extension portion, so as to constitute the linkage mechanism and the connector.

6. The manual tool having a retractable tool member according to claim 1, wherein axes of the third pivot and the fourth pivot are coincident.

7. The manual tool having a retractable tool member according to claim 1, wherein the fifth pivot is located at the first proximal end adjacent to the first handle portion; and the sixth pivot is located at the second proximal end adjacent to the second handle portion.

8. The manual tool having a retractable tool member according to claim 1, wherein the tool member is configured with a critical point when moving between the operating state and the retracting state; and when the tool member is at the critical point, the third pivot, the fourth pivot, the fifth pivot, and the sixth pivot are laterally aligned on the same straight line substantially.

9. The manual tool having a retractable tool member according to claim 1, wherein the tool member is a pliers head, the pliers head comprising a first pliers body and a second pliers body, the third pivot being located at a tail portion of the first pliers body, and the fourth pivot being located at a tail portion of the second pliers body;

an abutment portion is provided at the first tool end of the first linkage member and the second tool end of the second linkage member;

a groove is provided at the tail portion of the first pliers body and the tail portion of the second pliers body; and when the pliers head is in the operating state, the abutment portion abut against the groove.

10. The manual tool having a retractable tool member according to claim 1, wherein the manual tool further comprises a third linkage member that is equivalent to the first linkage member and a fourth linkage member that is equivalent to the second linkage member, the first linkage member being integrated with the third linkage member, and the second linkage member being integrated with the fourth linkage member.

11. A manual tool having a retractable tool member, further comprising a handle and a linkage member, wherein the handle comprises a first handle portion and a second handle portion, the first handle portion having a first proximal end and a first distal end, the second handle portion having a second proximal end and a second distal end, the first handle portion being rotatable about a first pivot located at the first proximal end, the second handle portion being rotatable about a second pivot located at the second proximal end, and the first pivot and the second pivot being connected through a connector;

the linkage member comprises a first linkage member and a second linkage member, the first linkage member having a first tool end and a first handle end, and the second linkage member having a second tool end and a second handle end;

the tool member comprises a first tool head and a second tool head opposite to the first tool head, and a third pivot is provide on the tool member, the first linkage member being rotatably connected with the tool member through the third pivot at the first tool end, and the second linkage member being rotatably connected with the tool member through the third pivot at the second tool end;

a fourth pivot is provided between the first proximal end and the first distal end of the first handle portion, the first linkage member being rotatably connected with the first handle portion through the fourth pivot at the first hand end, and a fifth pivot is provided between the second proximal end and the second distal end of the second handle portion, the second linkage member being rotatably connected with the second handle portion through the fifth pivot at the second handle end; and the tool member is configured to be retractably movable relative to the handle among a first operating state, a first retracting state, a second operating state, and a second retracting state under the driving of the handle and the linkage member.

12. The manual tool having a retractable tool member according to claim 11, wherein the first handle portion and the second handle portion are provided with a linkage mechanism at the first proximal end and the second proximal end.

13. The manual tool having a retractable tool member according to claim 12, wherein the linkage mechanism includes mutually matched circular-arc concave-convex grooves or splines.

14. The manual tool having a retractable tool member according to claim 12, wherein the first handle portion comprises a first component and a second component, and the second handle portion comprises a third component and a fourth component, the first component having a first extension portion that can match with the third component, the fourth component having a second extension portion that can match with the second component, the first component and the third component being pivotally connected to the first pivot at the first extension portion, and the second component and the fourth component being pivotally connected to the second pivot at the second extension portion, so as to constitute the linkage mechanism and the connector.

15. The manual tool having a retractable tool member according to claim 11, wherein the fifth pivot is located at the first proximal end adjacent to the first handle portion, the fifth pivot is located at the second proximal end adjacent to the second handle portion.

16. The manual tool having a retractable tool member according to claim 11, wherein the tool member is configured with a critical point when moving among the first operating state, the second operating state, the first retracting state, and the second retracting state, and when the tool member is at the critical point, the first pivot, the second pivot, the third pivot, the fourth pivot, and the fifth pivot are laterally aligned on the same straight line substantially.

17. The manual tool having a retractable tool member according to claim 11, wherein when the tool member is in the first operating state, the first tool head is deployed beyond the first proximal end and the second proximal end;

when the tool member is in the first retracting state, the tool member is retracted to a position between the first proximal end and the second proximal end and between the first distal end and the second distal end, and the first tool head faces the first proximal end and the second proximal end;

when the tool member is in the second operating state, the second tool head is deployed beyond the first proximal end and the second proximal end;

when the tool member is in the second retracting state, the tool member is retracted to a position between the first proximal end and the second proximal end and between the first distal end and the second distal end, and the second tool head faces the first proximal end and the second proximal end.

18. The manual tool having a retractable tool member according to claim 11, wherein the manual tool further comprises a third linkage member that is equivalent to the first linkage member and a fourth linkage member that is equivalent to the second linkage member, the first linkage member being integrated with the third linkage member, and the second linkage being integrated with the fourth linkage member.

19. The manual tool having a retractable tool member according to claim 11, wherein the first tool head and the second tool head are respectively a first pliers head and a second pliers head formed by alternatively hinging a first pliers body and a second pliers body at the third pivot.

20. The manual tool having a retractable tool member according to claim 11, wherein a groove is provided at positions where the first pliers head or the second pliers head abuts against the fourth pivot and the fifth pivot.

21. The manual tool having a retractable tool member according to claim 11, wherein the handle is provided with an arc-shaped groove at the fourth pivot and the fifth pivot, the fourth pivot and the fifth pivot being movable in the arc-shaped groove, so that an opening angle of the handle is more suitable for hold in the operating state, and an accommodation space in the handle is larger in the retracting state.

22. The manual tool having a retractable tool member according to claim 11, wherein the first tool head is a first tool bit or a first screwdriver bit, and the second tool head is a second tool bit or a second screwdriver bit.

* * * * *